US006109051A

United States Patent [19]

Majordy

[11] Patent Number: 6,109,051

[45] Date of Patent: Aug. 29, 2000

[54] FOOD PREPARATION TABLE WITH AIR BLAST CHILLER

[75] Inventor: Moe H. Majordy, Parsons, Tenn.

[73] Assignee: Manitowoc Foodservice Group, Inc., Sparks, Nev.

[21] Appl. No.: 09/311,609

[22] Filed: May 13, 1999

Related U.S. Application Data

[60] Provisional application No. 60/085,745, May 15, 1998.

[51] Int. Cl.[7] ..... F25D 23/12

[52] U.S. Cl. ..... 62/258; 62/414

[58] Field of Search ..... 62/258, 413, 414, 62/419, 426

[56] References Cited

U.S. PATENT DOCUMENTS

| | | | |
|---|---|---|---|
| 2,886,395 | 5/1959 | Cahn | 62/258 |
| 4,972,682 | 11/1990 | Smith et al. | 62/405 |
| 5,168,719 | 12/1992 | Branz et al. | 62/258 |
| 5,182,923 | 2/1993 | Trulaske, Sr. | 62/249 |
| 5,182,924 | 2/1993 | Tulaske, Sr. | 62/255 |
| 5,191,769 | 3/1993 | Mangini et al. | 62/418 |
| 5,205,129 | 4/1993 | Wright et al. | 62/68 |
| 5,282,367 | 2/1994 | Moore et al. | 62/256 |
| 5,355,687 | 10/1994 | Carpenter et al. | 62/258 |
| 5,363,672 | 11/1994 | Moore et al. | 62/258 |
| 5,381,672 | 1/1995 | Haasis | 62/419 |
| 5,433,082 | 7/1995 | Trulaske | 62/255 |
| 5,461,878 | 10/1995 | Moore et al. | 62/255 |
| 5,927,092 | 7/1999 | Kushen et al. | 62/258 |

*Primary Examiner*—William E. Tapolcai
*Attorney, Agent, or Firm*—Steven P. Shurtz; Brinks Hofer Gilson & Lione

[57] ABSTRACT

A food preparation table comprises a storage compartment; a food preparation surface above the storage compartment; a cold wall tank adjacent the food preparation surface and above the storage compartment, the tank having a liner forming the inside walls and floor of the tank, refrigerant cooling passageways in heat transfer relationship on the outside of the liner; and support rails; a plurality of food storage pans each having flanges for supporting the pans on the support rails and side and bottom walls forming the food storage portion of the pan and extending from the flanges downwardly into the tank; a refrigeration system comprising a source of compressed refrigerant, an evaporator and interconnecting refrigerant lines that supply refrigerant to the evaporator and the tank refrigerant cooling passageways; and an air distribution system which circulates air past the evaporator to cool the storage compartment and inside the tank where it impinges on the inside walls of the liner and from there onto the walls of the food pans.

17 Claims, 8 Drawing Sheets

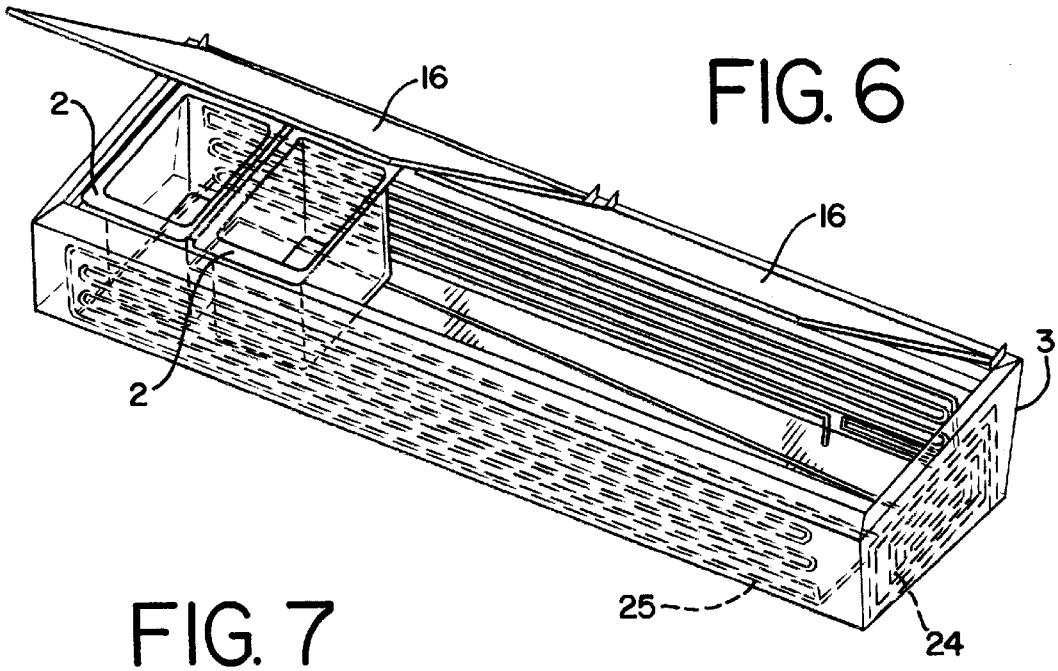
FIG. 6
FIG. 7
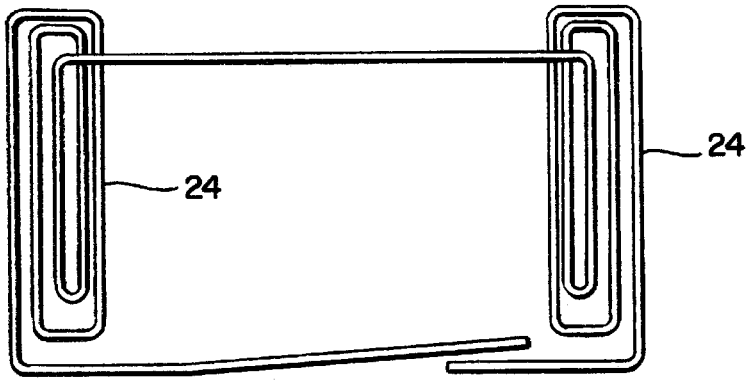
FIG. 8
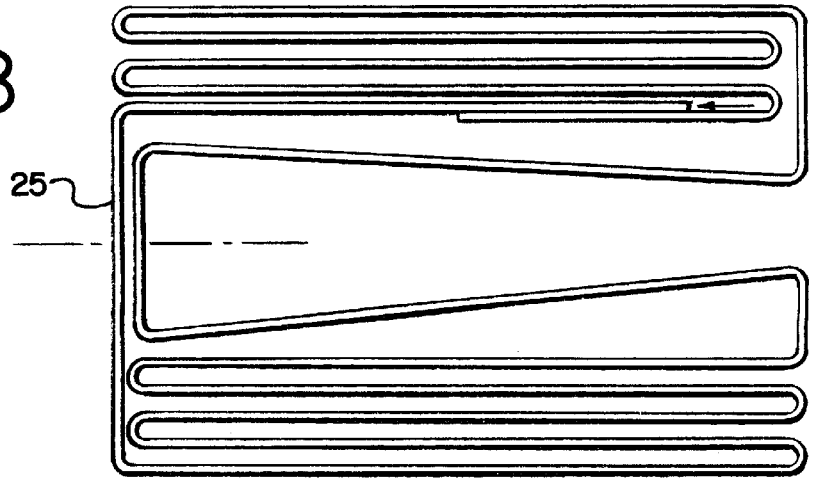

FOOD PREPARATION TABLE WITH AIR BLAST CHILLER

The present application claims the benefit under 35 U.S.C. § 119(e) of the filing date of Provisional U.S. Patent Application Ser. No. 60/085,745, filed May 15, 1998, which is hereby incorporated by reference.

FIELD OF THE INVENTION

The present invention relates to a food preparation table with a refrigerated compartment or tank into which open top pans for storing food products are placed. The present invention is particularly directed to an improved pizza preparation table.

BACKGROUND OF THE INVENTION

In the food service industry, there is a need for refrigerated food storage in which different food items are readily available for preparation of foods such as sandwiches and pizza. In the "fast food" industry it has become a common practice to utilize preparation tables, which make the foodstuffs conveniently available to preparation personnel while maintaining the foodstuffs properly refrigerated.

Preparation tables, such as those used in fast food service, are typically constructed as a table in an arrangement, which provides refrigerated food storage and a work surface for food preparation. In a typical arrangement, the preparation table is provided with refrigerator cabinets under the table top for overnight food storage, a flat working surface at the front of the table top and a so-called "rail" which is part of the work area near the back of the table. The rail is an open-top refrigerated compartment usually extending the width of the table, with the open-top elevated several inches above the flat work surface at the front. The rail arrangement is used for ergonomic reasons and the refrigerated compartment thereof is provided with a plurality of open top food pans that are disposed side-by-side across the width of the rail. With the open top food pans supported near the upper surface of the rail, the food is easily reachable by the food preparation person standing at the front of the table. The refrigerated compartment in the rail is typically known as a "cold wall" pan or tank comprising a sheet metal open top pan or tank with refrigerant tubing bonded to the exterior surface of the pan liner. The tank constitutes the side walls and bottom wall of a refrigerated compartment and the food pans are supported therein by a rim or flange on the front and back of the pans which rest on ledge, or rails, inside the tank.

One of the difficulties with this arrangement is that the food in the upper portion of the open food pans is subjected to the ambient room temperature, which may be high enough to cause degradation of the food quality. With the food pans supported so that they extend downwardly into the refrigerated compartment, the food in the bottom of the pans is adequately refrigerated, but the food in the top of the pans may not be. Several possible solutions to this problem have been suggested. One is to lower the temperature of the cold wall tank. However, in the case of a high ambient temperature, when the temperature of the air below the pans is reduced adequately to maintain the food in the upper portion of the pans sufficiently cooled, freezing of food in the lower portion is likely to occur. It is desirable, in general, for proper food preservation to maintain the food at a temperature no higher than 40° F., but higher than the freezing temperature.

Recently the National Sanitation Foundation (NSF) has promulgated a standard that requires all the food in the pans to be maintained at a temperature in the range of 33° F. to 41° F. Some food preparation tables have been promoted as meeting this standard. However, prior art food preparation tables have a number of drawbacks.

For example, the food preparation table disclosed in U.S. Pat. No. 5,363,672 has additional heat sink walls built on top of the typical cold wall pan, which are designed to provide an upper cooling zone above the product pans. One problem with this design is that the food preparation worker has to reach deeper to pick up food items in the pan. Worse yet, the heat sink walls are cold enough that moisture in the air can condense on them and run down into the product pans.

Other food preparation table designs have relied on a curtain of cold air being blown across the top of the food pans. U.S. Pat. Nos. 5,168,719 and 5,282,367 disclose food preparation tables with such a design feature. One drawback to this design is that the air that blows across the tops of the pans tends to dry out the food stored in the pans. Also, there is a high level of cold air lost to the room and warm air infiltration into the system.

Another food preparation table design is disclosed in U.S. Pat. No. 5,355,687. This design utilizes a plurality of cooling elements running perpendicular to the length of the tank. In this way each food product pan is surrounded on all sides by either the cold wall of the tank or an auxiliary cooling element. One of the problems encountered with this design is that the cooling area is thus divided up into "pigeon holes," and only product pans of the same dimension as the "pigeon holes" can be used. That is, a particular user cannot decide to interchange wider pans than those designed into the table. Since each food preparation table may be put to different uses, where different amounts of one product or another are preferably stored in an accessible location, and wherein the pan dimensions most desirable for use may change over the life of the food preparation table, if not quite frequently, this lack of flexibility is a distinct disadvantage, compared to most food preparation tables, where any combination of pan sizes can be utilized so long as they all fit within the length of the rail. Further, the amount of pan space is reduced by the space taken up by the auxiliary cooling elements.

Other designs have removed the bottom of the tank so that the cold air in the storage cabinets comes into contact with the bottom of the pans. One drawback to this design is that anything that spills or condenses in the tank can fall down into and contaminate food stored in the lower cabinets.

Another problem that has to be dealt with is that the food preparation table should be able to accommodate pans of the different standard depths, such as 4-inch and 6-inch deep pans. When 6-inch deep pans are to be used, there is very little room between the bottom of the pans and the conventionally designed cold wall tanks. If the tank were made taller, it would be more difficult to reach up into the pans to remove the food, and may not fit into the space available, which was designed for an earlier, shorter model food preparation table. Alternatively, if the tank were made deeper, it would encroach into the storage compartment space.

Thus, there is a need for a food preparation table that can meet the NSF standard without the drawbacks noted above. In particular, it would be advantageous if a food preparation table could be constructed with little modification to conventional designs so that existing manufacturing fixtures and designs can be utilized as much as possible, and the resulting food preparation table will fit within the space designed for prior tables.

SUMMARY OF THE INVENTION

A food preparation table has been invented which can meet the NSF standard without the drawbacks noted above. In a first aspect, the invention is a food preparation table comprising a) a storage compartment; b) a food preparation surface above the storage compartment; c) a cold wall tank adjacent the food preparation surface and above the storage compartment, the tank comprising i) a liner forming the inside walls and floor of the tank; ii) refrigerant cooling passageways in heat transfer relationship on the outside of the liner; and iii) support rails; d) a plurality of food storage pans each having flanges for supporting the pans on the support rails and side and bottom walls forming the food storage portion of the pan and extending from the flanges downwardly into the tank; e) a refrigeration system comprising a source of compressed refrigerant, an evaporator and interconnecting refrigerant lines that supply refrigerant to the evaporator and the tank refrigerant cooling passageways; and f) an air distribution system which circulates air past the evaporator to cool the storage compartment and inside the tank where it impinges on the inside walls of the liner and from there onto the walls of the food pans.

By using an air circulation system that causes air to impinge on the cold wall of the liner and then to contact the product pans, the pans can be adequately cooled without freezing the content of pans. The air circulation system can be built into existing pizza preparation table designs with fairly little modification. Preferably the temperature of the walls of the tank is set by an evaporator pressure regulating (EPR) valve such that there is no chance that the impinging air will be cold enough to freeze food in the product pans, even if the lids on the pizza table are closed over the tops of the pans, such as at night when the table is not in use.

These and other advantages of the invention will be best understood in view of the attached drawings.

BRIEF DESCRIPTION OF THE DRAWINGS

FIG. 6 is a schematic drawing showing the placement of refrigerant tubing around a liner in the cold wall tank of FIG. 4.

FIG. 7 is a schematic drawing of the refrigerant tubing used on the ends of the cold wall tank of FIG. 4 prior to the ends being folded up to fit against the ends of the tank liner.

FIG. 8 is a schematic drawing of the refrigerant tubing used on the sides and bottom of the cold wall tank of FIG. 4 prior to the sides being folded up to fit against the sides of the tank liner.

DETAILED DESCRIPTION OF THE DRAWINGS AND PREFERRED EMBODIMENTS OF THE INVENTION

The preferred food preparation table of the present invention is a pizza preparation table 1 as shown in FIGS. 1–8. The pizza table 1 is very similar to a two-section pizza preparation table Model PTA-20 from McCall Refrigeration, Parsons, Tennessee. Because of that similarity, many details of the pizza table 1 will not be described herein. Instead, those features by which the Model PTA-20 was modified to create the present invention will be focused on.

Figure 12:
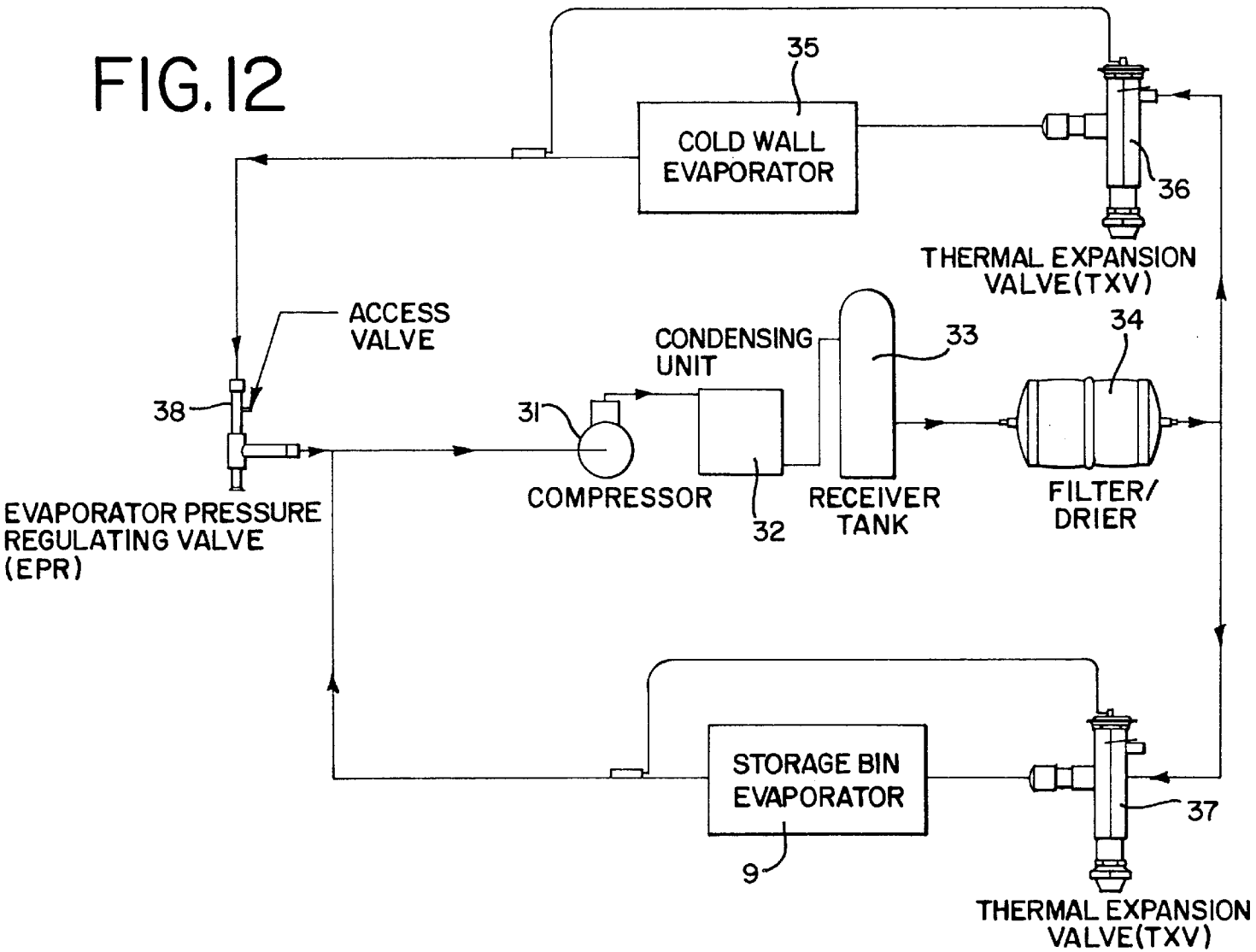
FIG. 12 is a schematic drawing of the refrigeration system used in the food preparation table of FIG. 1.

The pizza table 1 is conventional in that it has a cabinet 5 that encloses two bottom storage compartments 17 (FIG. 2), closed by cabinet doors 6, and a machine compartment 10, housing a compressor and condenser (shown schematically in FIG. 12). On top of the cabinet are a tabletop 4 and a cold wall tank 3. Tank lids 16 may be closed when the table 1 is not in use. Inside the tank 3 are multiple food product pans 2, only two of clarity. In use, the entire tank 3 would be filled with pans 2, which can have different widths depending on the preference of the user.

The pizza table 1 is also conventional in that an evaporator coil 9 is located between compartments 17 in a wall structure with fans 8. The fans draw air up from the bottom of the compartments 17, past the evaporator coil 9 and circulate the refrigerated air throughout the compartment 17. A drip tray 7 is located under the evaporator coil to collect any moisture that may condense on the evaporator coil 9.

The cold wall tank 3 is also conventional in some respects. It is made with of two pieces of sheet metal formed into respectively an inner liner 19 and an outer housing 18 with foam insulation 12 in between, best seen in FIG. 5. Refrigerant passageways are connected in a heat transfer relationship with the liner 19. Preferably, refrigerant tubing 25 is taped with metal tape to the outside of the liner 19 and covered with foam insulation 12.

Figure 3:
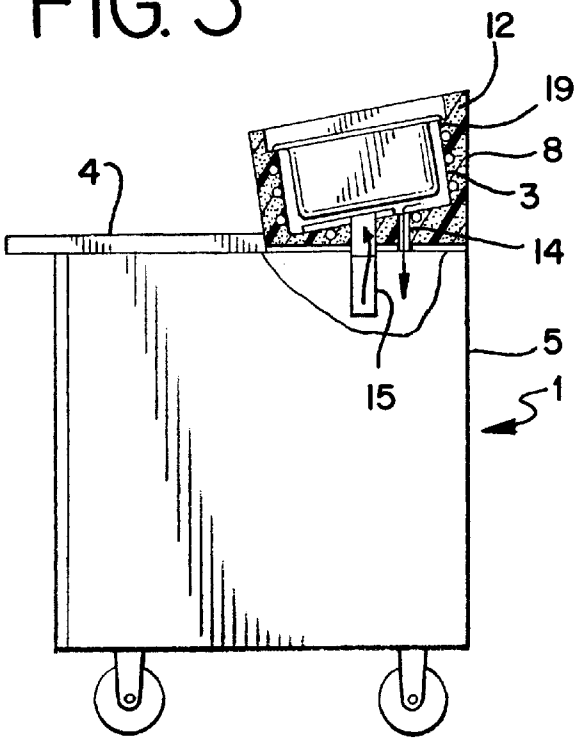
FIG. 3 is a side view, partially in cross-section, of the food preparation table of FIG. 1.
Figure 1:
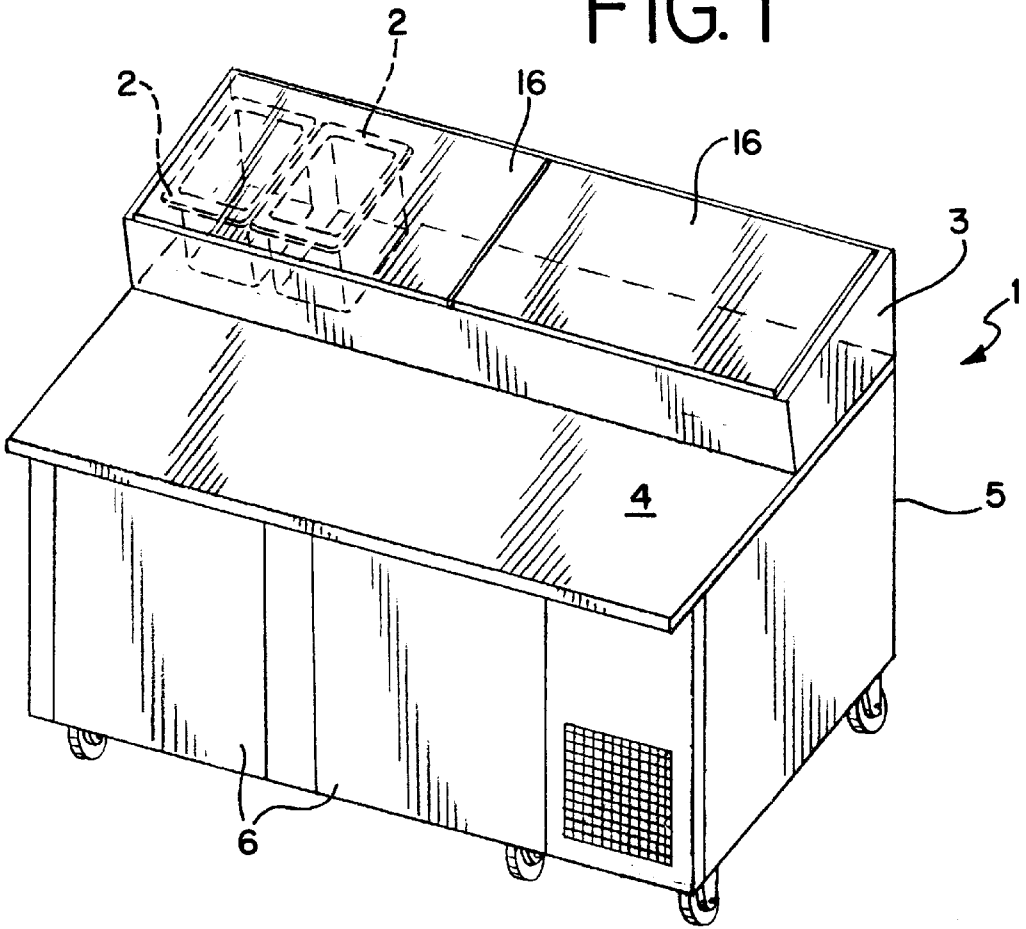
FIG. 1 is a perspective view of a first preferred embodiment of a food preparation table of the present invention.
Figure 2:
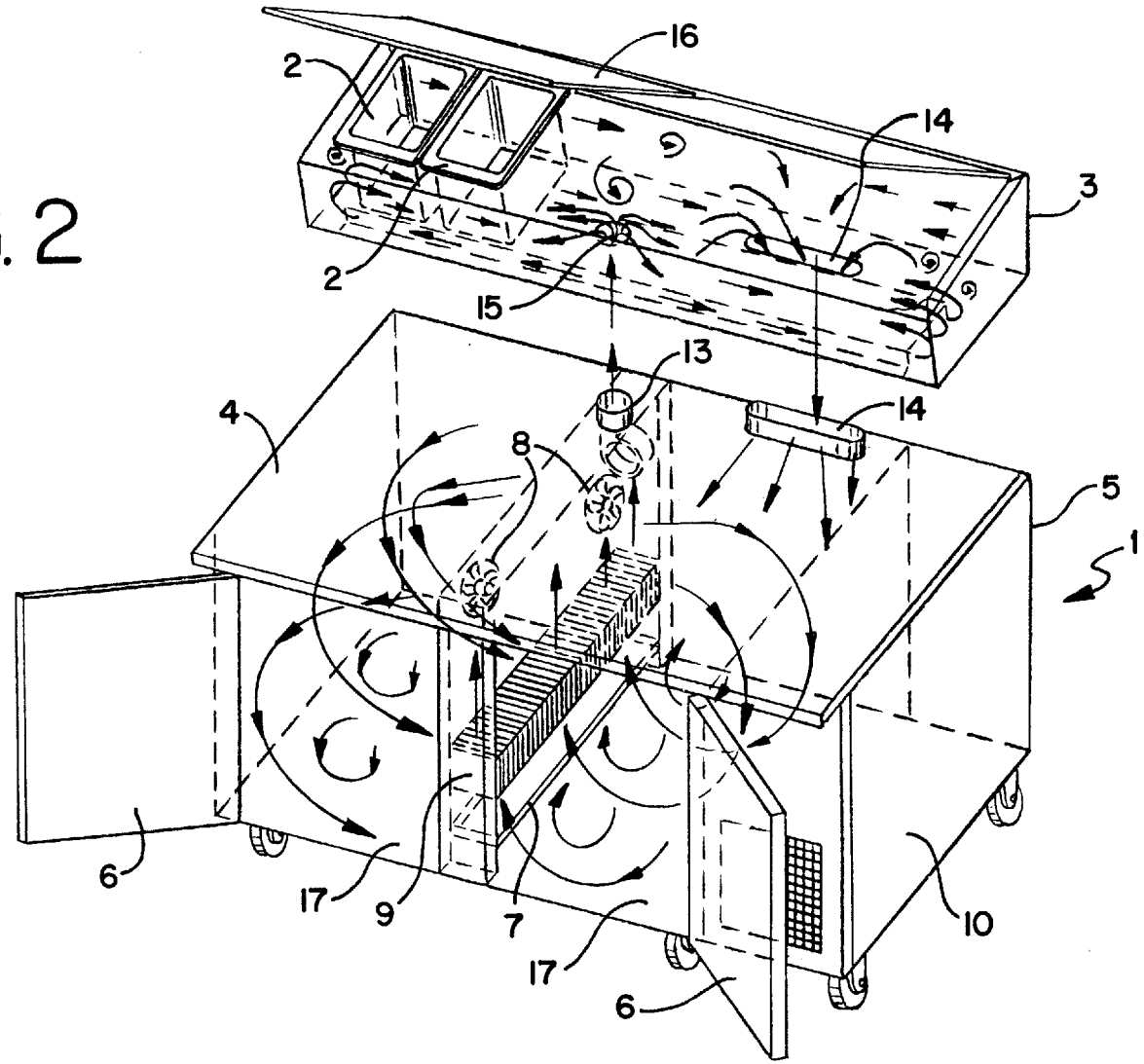
FIG. 2 is a perspective, partially exploded view of the food preparation table of FIG. 1.
Figure 4:
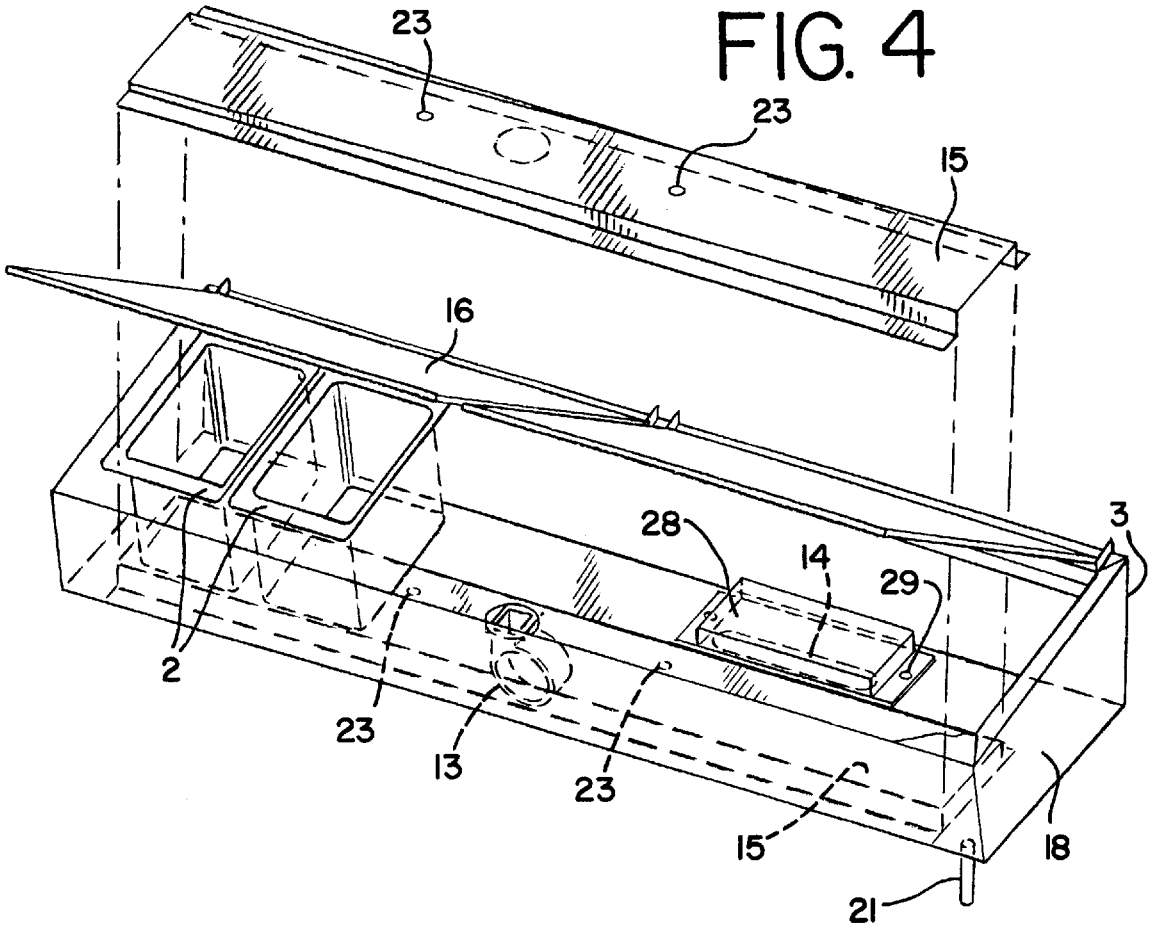
FIG. 4 is an exploded view of the cold wall tank used in the food preparation table of FIG. 1.
Figure 5:
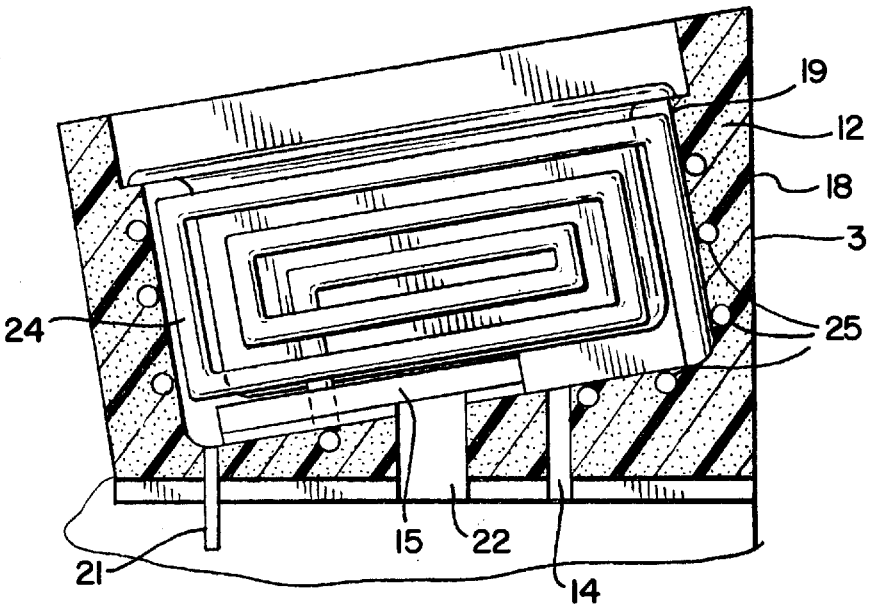
FIG. 5 is a schematic, cross-sectional view of the cold wall tank of FIG. 3.

The cold wall tank 3 and cabinet 5 have been modified in the first embodiment of the invention to include a blower 13 (FIGS. 2 and 4), a tank supply duct 15 and an air return duct 14, best seen in FIGS. 4–5. A channel 22 acts as a supply air inlet between the blower 13 and the supply duct 15. In FIG. 4 the supply air duct 15 is shown in full lines up above the tank 3, and in phantom lines within the tank 3 on the bottom of the liner 19 where it is properly positioned for use. A return air duct cover 28 covers the opening of the air return duct 14 in the bottom of the tank 3. Preferably the cover 28 is held on by nylon screws 29.

It should be noted that the liner 19 is made with a sloped bottom, as is conventional, so that any condensate in the tank 3 will run to one end and out a drainpipe 21. As a result, the tank duct 15 in this first embodiment has a different height over its length, so that it will fit under the deepest product pans 2 to be used in the tank 3. The location of the blower 13 and hence the supply air inlet 22 into the duct 15 is generally going to coincide with the location of the evaporator coil 9, so that cooled air coming directly off of the evaporator coil will be forced through the blower 13 into the duct 15. On the other hand, the location of the return air inlet 14 is positioned so as to return air from the tank 3 into one of the compartments and to best regulate airflow within the tank. For example, the evaporator coil is generally located off center of the table 1, since it is between the compartments 17 and the compartments 17 are of equal size but the machine compartment 10 fills up one end of the cabinet 5. Since the tank 3 is usually as long as the entire cabinet 5, the supply air inlet 22 will typically be located (at least in a two compartment pizza table) closer to one end of the duct 15 than the other. Also, because the duct has different cross sectional heights to accommodate the slop of the bottom of the liner 19, airflow out the ends of the duct 15 will not be uniform. Placement of the air return can then be designed to assure proper airflow within the tank 3.

The most significant aspect of the duct design is that it causes air to impinge on the end walls of the tank 3, which are fitted with refrigerant cooling as explained below. The air is preferably forced by the blower 13 at high flow rates, such as 50 cfm at 0.2 inches of water static pressure. The air thus exits the ends of the duct 15 at a high velocity so that it has good convection heat transfer with the chilled end of the tank 3. In one embodiment, the duct 15 is only ⅛ inch shorter than the inside of the liner 19. As a result the duct end is only 1/16 of an inch from each end of the liner. The preferred duct 15 has an opening of about ¾ inch high at one end and 3/16 inch high at the other end.

In the embodiment depicted in FIG. 4, extra supply air outlets 23 are formed in the top of the duct. However, at present it is believed that these outlets are not very effective because the air that flows through them, while being cooled by evaporator coil 9, does not impinge on the cold walls of the tank, and hence is not cold enough to adequately cool the food product pans 2. Therefore preferably only two outlets 23 are provided.

As noted above, the end walls of tank 3 need to be cooled for the duct embodiment of FIG. 4. This is accomplished by adding additional refrigerant tubing 24 in heat transfer connection with the ends of the tank liner 19. The refrigerant tubing in place on the outside of the liner 19 is shown in FIG. 6. The shape of the additional refrigerant tubing 24 prior to being folded on its ends to fit against the end walls of the liner is shown in FIG. 7. FIG. 8 shows the conventional refrigerant tubing 25 that is used on the bottom and side walls of the liner 19 before it is bent. In the preferred embodiment of the invention the additional section of refrigerant tubing 24 is connected at one end with the regular section 25. The second ends of the extra tubing 24 and regular tubing 25 are connected to the remainder of the refrigeration system in a conventional fashion.

FIG. 12 shows the refrigeration system used in the preferred embodiment of the invention. It is conventional in that the refrigeration system circuit includes a compressor 31, a condenser 32 (housed in machine compartment 10) as well as a conventional receiver tank 33 and filter/drier 34. From the filter/drier 34 refrigerant can flow to either evaporator 9 in the storage bin or to the cold wall evaporator 35, made up of tubing sections 24 and 25 in cold wall tank 3. Conventional thermal expansion valves 36 and 37 precede the evaporator on both parts of the system. An evaporator pressure regulating (EPR) valve 38 is included on the cold wall tank portion of the refrigeration circuit. However, both portions of the circuit are rejoined at a common suction line back into the compressor.

When a thermostat (not shown) in the storage compartment 17 indicates a need for more refrigeration, the compressor starts up. The thermal expansion valves 36 and 37 meter refrigerant into the evaporators 9 and 35, depending on the outlet temperature of the evaporators.

During the compressor on time, the EPR valve 38, with a pressure setting of 62 PSIG, keeps the tank wall temperature from falling below 25° F. During the compressor off time, the refrigerant (preferably 404A) that remains in the cold wall tubing sustains the tank temperature until the compressor restarts.

The temperature of the air stream coming off the ends of the tank liner from duct 15 stays between 33° to 35° F., about 8 to 10° F. above the tank wall temperature. This circulating air provides the dominant cooling mechanism for the product in the pans 2. Even though the tank walls are below freezing, the pans 2 are kept from freezing because they are suspended in the well of the tank and do not contact the side or end walls of the liner 19.

Figure 9:
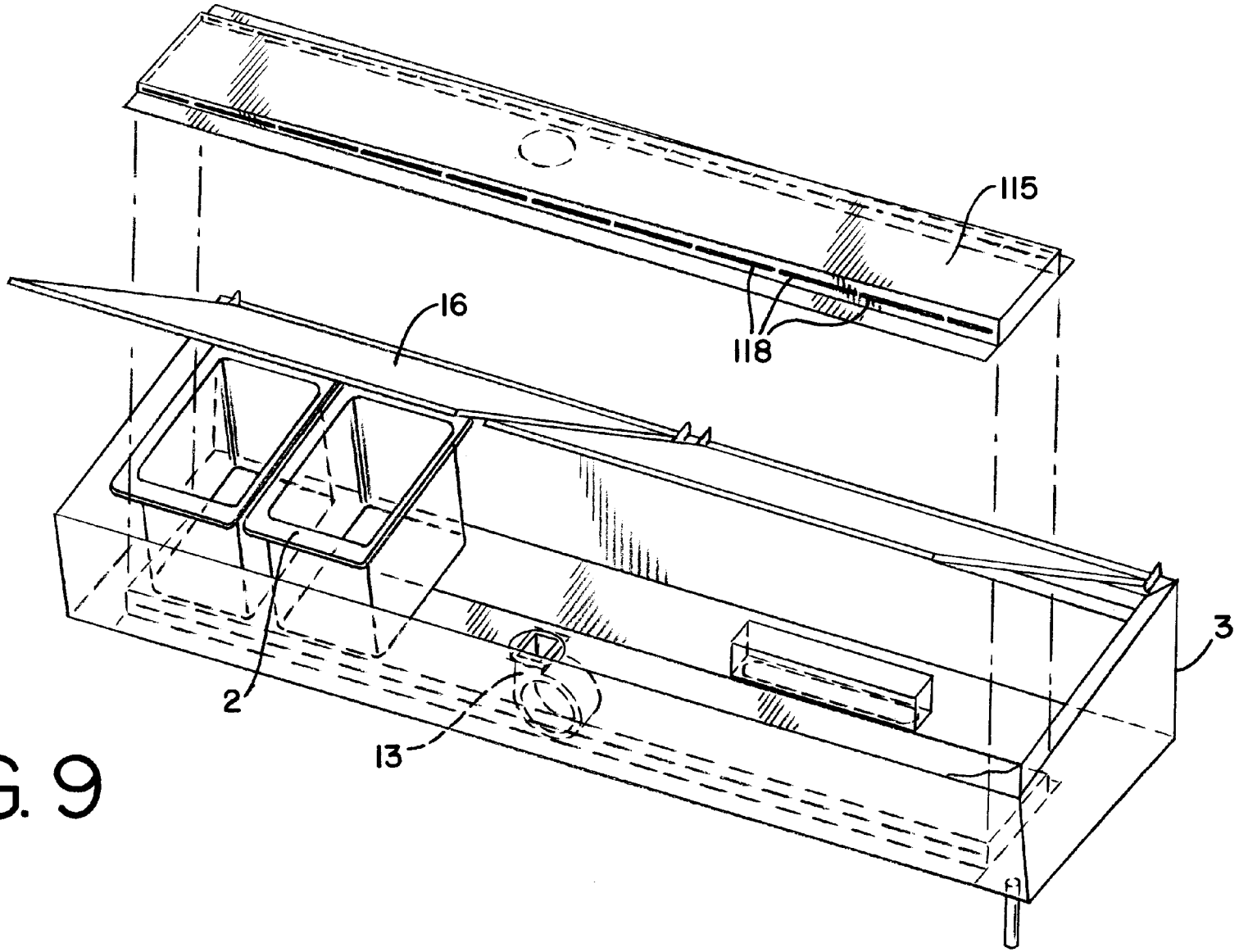
FIG. 9 is an exploded view of a second embodiment of a cold wall tank that can be used with a food preparation table as in FIG. 1.
Figure 10:
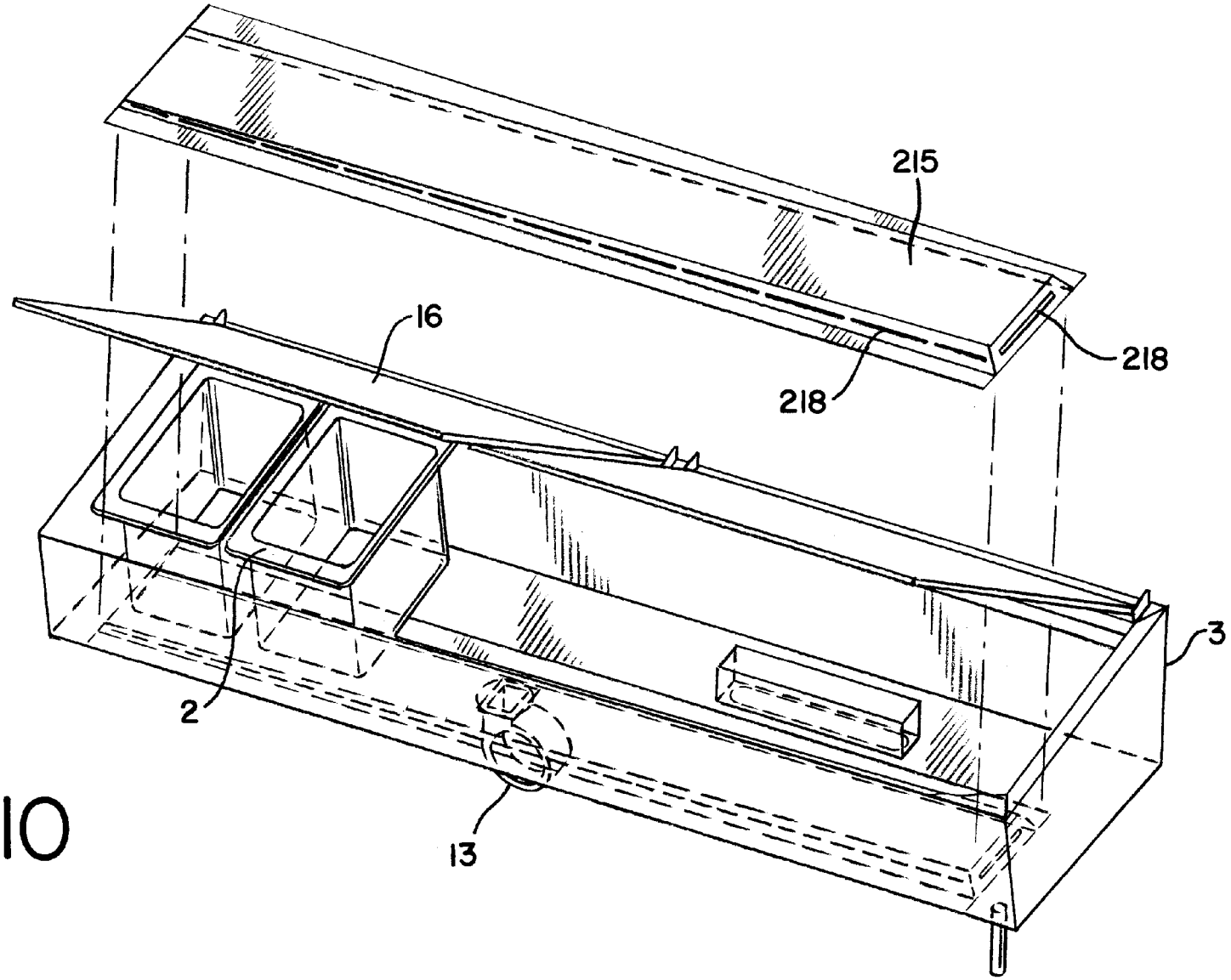
FIG. 10 is an exploded view of a third embodiment of a cold wall tank that can be used with a food preparation table as in FIG. 1.
Figure 11:
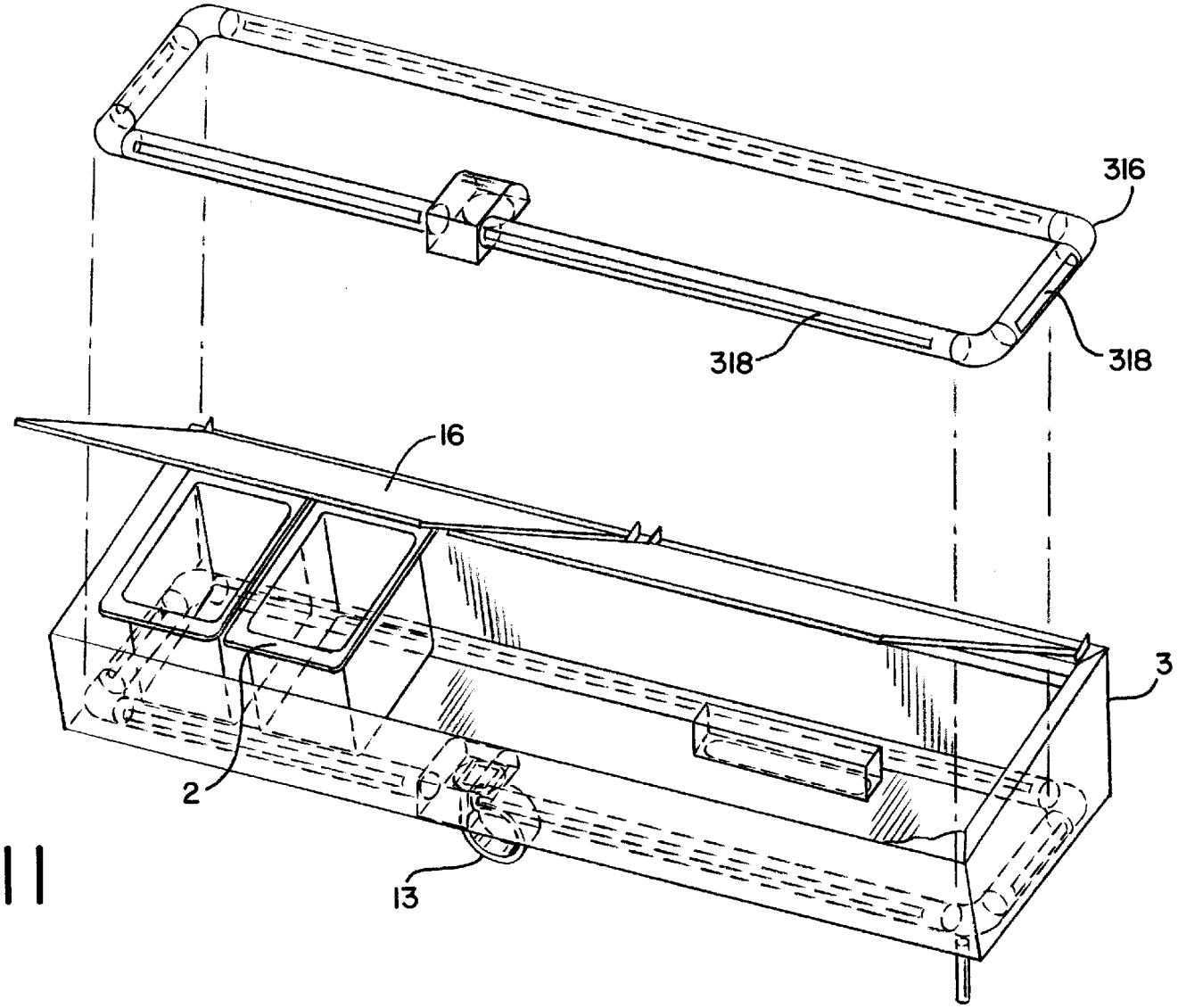
FIG. 11 is an exploded view of a fourth embodiment of a cold wall tank that can be used with a food preparation table as in FIG. 1.

FIGS. 9, 10 and 11 show second, third and fourth embodiments of the cold wall tank. In the second embodiment shown in FIG. 9, the duct 115 is slotted on its sides, and preferably still open on its ends. As a result, air is forced out of the slots 118 on the sides of the duct and impinges at a high rate of speed on the side walls of the liner 19. The refrigerant tubing for this embodiment may be modified so that the side walls are provided with adequate heat transfer.

In the third embodiment, shown in FIG. 10, slots 218 are provided in the ends as well as on the sides of the duct 215. Hence air impinges not only on the side walls, but also on the end walls of the liner 19, which are appropriately cooled. The sides and ends of the duct can be beveled, such as at a 45° angle as shown, so that the air is blasted upward and outward toward the walls of the tank.

In the fourth embodiment, shown in FIG. 11, the duct is in the form of a closed loop pipe 316. The pipe includes slots 318 on the sides and the ends of the rectangular loop. The slots are preferably positioned on the outside of the pipe so as to direct the air partially upward as well as outwards toward the walls of the liner. The pipes can have round cross sections as shown, or could be oval, triangular, square or some other cross section.

Preferably the duct, regardless of its construction, will be configured so that the air exits the duct in close proximity to the walls of the tank, to maximize the connective heat transfer.

The preferred pizza tables have several advantages. Full or half size metal pans or their combination may be used. The pizza tables do not employ an air curtain. Accordingly, the air movement in the surrounding environment does not affect the on-going cooling process in the tank. Pans are blast chilled from the sides and bottoms. Food products stored in the pans will not be dehydrated or adversely affected by the blasting air under the pans. Access to the food product pans is full and unrestricted by confining barriers. No hutch, skirt or other confining walls are used around the products. On the other hand, the bottom of the tank is not open to the food storage cabinets below. A cover over the return air duct prevents food dropped inside the tank from falling through the return air inlet. Cabinet internal spacing is not occupied or restricted by auxiliary components such as blowers or ductwork. The blower used is in the wall between the compartments 17. Storage capacity in the compartments 17 is not reduced by a deepened tank that would occupy part of the compartment 17 storage space. The tables can be built using many of the same parts and manufacturing fixtures used to build other food preparation tables.

It should be appreciated that the apparatus of the present invention is capable of being incorporated in the form of a variety of embodiments, only a few of which have been illustrated and described above. For example, in a larger pizza preparation table, having three compartments 17 and two evaporators 9, two blowers 13 could be used to supply air to a common duct 15. Two separate refrigeration systems could be used, with their own compressors, condenser and thermostat, one for the cold wall tank and one for the food storage compartment. The invention may be embodied in other forms without departing from its spirit or essential characteristics. The described embodiments are to be considered in all respects only as illustrative and not restrictive, and the scope of the invention is, therefore, indicated by the appended claims rather than by the foregoing description. All changes that come within the meaning and range of equivalency of the claims are to be embraced within their scope.

What is claimed is:

1. A food preparation table comprising:

a) a storage compartment;

b) a food preparation surface above the storage compartment;

c) a cold wall tank adjacent the food preparation surface and above the storage compartment, the tank comprising:

i) a liner forming the inside walls and floor of the tank;

ii) refrigerant cooling passageways in heat transfer relationship on the outside of the liner; and iii) support rails;

d) a plurality of food storage pans each having flanges for supporting the pans on the support rails and side and bottom walls forming the food storage portion of the pan and extending from the flanges downwardly into the tank;

e) a refrigeration system comprising a source of compressed refrigerant, an evaporator and interconnecting refrigerant lines that supply refrigerant to the evaporator and the tank refrigerant cooling passageways; and f) an air distribution system which circulates air past the evaporator to cool the storage compartment and inside the tank where it impinges on the inside walls of the liner and from there onto the walls of the food pans.

2. The food preparation table of claim 1 wherein the refrigeration and air circulation system are capable of keeping food products in the food storage pans at a temperature between 33° F. and 41° F. when the food preparation table is housed in a room with an ambient temperature of 85° F.

3. The food preparation table of claim 1 wherein the air circulation system comprises one or more fans for forcing air past the evaporator and circulating the air in the storage compartment and one or more blowers for blowing air from the storage compartment into the bottom of the tank.

4. The food preparation table of claim 3 wherein the air distribution system comprises an air supply duct on the floor of the tank into which the blower blows air, the duct having one or more outlets configured to blow the air against the walls of the liner.

5. The food preparation table of claim 4 wherein the duct is open on its ends so as to direct air against opposing end walls of the liner, and the end walls of the liner have refrigerant tubing attached thereto cooling the end walls.

6. The food preparation table of claim 5 wherein there is a gap of about 1/16 inch between the ends of the duct and the end walls of the liner.

7. The food preparation table of claim 4 wherein the duct has outlet slots in the side thereof to direct air against the side walls of the liner.

8. The food preparation table of claim 7 wherein the duct further includes slots to direct air against the end walls of the liner.

9. The food preparation table of claim 4 wherein the duct comprises a closed loop pipe with air outlets facing the liner walls.

10. The food preparation table of claim 1 wherein the refrigerant cooling passageway comprises refrigerant tubing attached to the outside of the liner walls.

11. The food preparation table of claim 10 wherein the liner is rectangular in shape and the tubing is in contact with the side and end walls and the bottom of the liner.

12. The food preparation table of claim 1 wherein the air circulation system comprises a blower which supplies at least 50 cfm of air at a static pressure head of 0.2 inches of water into the tank.

13. The food preparation table of claim 1 wherein the liner is surrounded by insulation.

14. The food preparation table of claim 1 wherein the refrigeration system is designed to keep the tank liner at a temperature of not less than about 25° F. regardless of product load or whether lids are closed over the tank.

15. The food preparation table of claim 1 designed as a pizza preparation table.

16. The food preparation table of claim 15 wherein the food pans are supported at an elevation higher than the food preparation surface.

17. In a food preparation table having a bottom storage compartment, a food preparation surface, a cold wall tank having refrigerant tubing in heat transfer relationship on the outside thereof and housing a plurality of open-top food pans, and a refrigeration system supplying cold air to the bottom storage compartment and refrigerant to the cold wall tank tubing, the improvement comprising a blower in the bottom storage compartment and an air distribution system in the cold wall tank configured to distribute air blown by the blower from the bottom storage compartment so that it impinges on the inside walls of the cold wall tank and thereafter cools the food pans.

* * * * *